United States Patent [19]

Bradbury et al.

[11] Patent Number: 4,779,200

[45] Date of Patent: Oct. 18, 1988

[54] METHOD FOR ESTIMATING POROSITY AND/OR PERMEABILITY

[75] Inventors: Leslie J. S. Bradbury, Surrey; David B. White, Cambridge, both of England

[73] Assignee: Schlumberger Technology Corporation, New York, N.Y.

[21] Appl. No.: 756,479

[22] Filed: Jul. 16, 1985

[30] Foreign Application Priority Data

Jul. 19, 1984 [GB] United Kingdom ..... 8418429

[51] Int. Cl.[4] ..... G06F 15/20; G01V 1/28; E21B 49/08

[52] U.S. Cl. ..... 364/422; 73/155

[58] Field of Search ..... 364/422; 73/155

[56] References Cited

U.S. PATENT DOCUMENTS

| | | | |
|---|---|---|---|
| 2,189,919 | 2/1940 | Moore | 166/1 |
| 3,285,064 | 11/1966 | Greenkorn et al. | 73/155 |
| 3,559,476 | 2/1971 | Kuo et al. | 73/155 |
| 3,586,105 | 6/1971 | Johnson et al. | 166/250 |
| 3,604,256 | 9/1971 | Prats | 73/155 |
| 4,328,705 | 5/1982 | Gringarten | 73/155 |
| 4,348,897 | 9/1982 | Krauss-Kalweit | 73/155 |

*Primary Examiner*—Jerry Smith
*Assistant Examiner*—Charles B. Meyer

[57] ABSTRACT

In a drill stem test, a packer is set in the well bore to isolate a potential producing zone. A drill pipe with a down hole valve is fitted through the packer. The pipe is usually partially filled with a liquid column prior to commencement of the test, which essentially comprises opening the valve so that formation fluids can flow into the drill pipe and measuring various parameters associated with the fluid transfer. A method for estimating porosity and/or permeability includes the steps of setting up such a drill stem test wherein flow of formation fluid to a drill pipe may be controlled by a down hole valve, opening the valve to establish a flow, recording flow parameters, and analyzing oscillatory transients in the flow to compute therefrom estimates of porosity and permeability.

19 Claims, 3 Drawing Sheets

METHOD FOR ESTIMATING POROSITY AND/OR PERMEABILITY

This invention relates to the estimation of porosity and/or permeability, and in particular to the estimation of porosity and/or permeability of geological formations into which a well bore has been drilled. Porosity is a controlling factor governing the amount of oil in place in a producing formation, while permeability is a controlling factor governing the ability of the oil to flow out of the formation. Estimates of porosity and permeability are therefore required in oil exploration to assess potential producing zones.

A test which is often performed during a drilling operation is the drill stem test (DST). In a DST, a packer is set in the well bore to isolate a potential producing zone. A drill pipe with a down hole valve is fitted through the packer. The pipe is usually partially filled with a liquid column prior to commencement of the test, which essentially comprises opening the valve so that formation fluids can flow into the drill pipe and measuring various parameters associated with the fluid transfer. It is usual, for example, to measure pressure downhole during the time the fluid flows and for a longer period after the flow is stemmed by closing the valve.

DST data may be analysed to yield much information about the potential zone, but in the past it was not thought possible to obtain formation porosity, nor was it believed possible to obtain formation porosity and permeability in the region of the formation close to the borehole. The present invention has been made as a result of analysing the mechanics of drill stem testing, and of investigating the effects of formation porosity and permeability on the behaviour of the test results.

According to the present invention, a method for estimating a parameter relating to the porosity and/or the permeability of an earth formation surrounding a well bore includes the steps of setting up a drill stem test wherein flow of formation fluid to a drill pipe may be controlled by a down hole valve, opening the valve to establish a flow, measuring successive values of a parameter relating to said flow, analysing said values to identify an oscillatory transient of said flow and computing from said oscillatory transient said parameter relating to porosity and/or permeability.

When the downhole valve is opened, the flow is subject to the aforementioned oscillatory transient before settling to a flow equilibrium state or a non-oscillatory slowly changing state. The oscillatory transient manifests itself as an oscillatory pressure and flow velocity, and may be measured directly by a flow rate transducer, or indirectly by a pressure transducer, or better still by both.

In a preferred implementation of the invention, the permeability-porosity product is determined from the frequency of said oscillatory transients and/or separately from the rate of decay (or damping) of said oscillatory transients.

Advantageously, the porosity is separately determined from the peak oscillatory flow velocity, while the permeability may be separately determined from the peak non-oscillatory flow velocity.

In order that further feaatures and advantages of the present invention may be appreciated, an example will now be described with reference to the accompanying diagrammatic drawings, of which:

Figure 1:
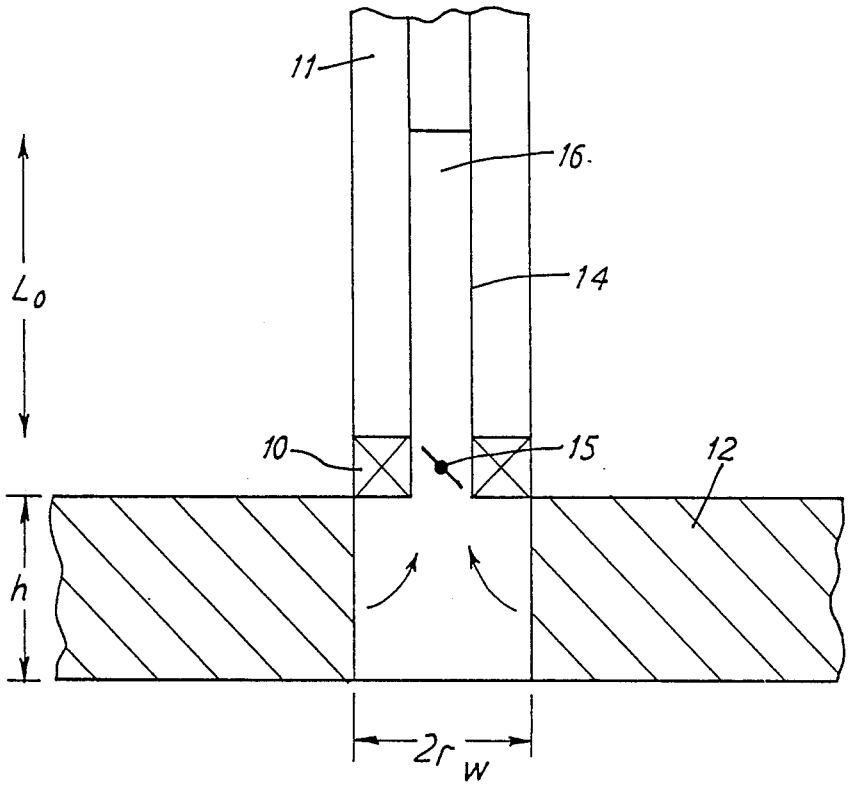
FIG. 1 represents a typical DST configuration.

In a drill stem test (FIG. 1) a packet 10 is insetted down a well bore 11 of radius $r_w$ to isolate a formation zone 12 of potential production. A drill pipe 14 of cross sectional area A and with a down hole valve 15 is fitted through the packer 10 and partly filled to a known height $L_o$ with a fluid 16. When the valve 15 is opened, formation fluid 17 flows into the pipe 14. The velocity of the flow is measured indirectly by a pressure transducer (not shown) in accordance with known DST procedure. Initially the flow is oscillatory, which results in an oscillatory pressure variation downhole. This oscillatory transient is recorded by the pressure transducer and analysed to establish the frequency of the oscillation, as well as other parameters which will be discussed hereinafter.

In the course of making the present invention, system behaviour as the valve is opened during a DST has been carefully studied. A theoretical model of the system has been developed, and extensive theoretical and numerical analysis has been applied to this model. From theoretical analysis, it is found that the frequency n of both the flow and the pressure oscillations is given by:

$$n = n_o\left[1 - \frac{\sqrt{2}}{4}\,\epsilon\,(k\phi)^{\frac{1}{2}}\right] \tag{1}$$

$$\text{where } n_o = \frac{1}{2\pi}\sqrt{\frac{A}{\pi r_w^2 h\rho c L_o}} \tag{2}$$

$$\text{and } \epsilon = \left[\frac{16\pi h L_o \rho c}{A r_w^2}\right]^{\frac{1}{4}}\left[1 + \frac{A}{\rho c g \pi r_w^2 h}\right]^{5/4} \tag{3}$$

and h=vertical extent of the formation $\rho$=density of the well bore fluid c=compressibility of the well bore fluid k=formation permeability $\phi$=formation porosity g=acceleration due to gravity It will be appreciated that the permeability-porosity product $k\phi$ has been expressed in terms which are either known as a result of the drilling geometry ($A, r_2$), or can be measured by taking fluid samples ($\rho$,c), or are under the control of the tester ($L_o$), or can be established by standard well logging techniques (h), in addition to the measured frequency n of either pressure or flow. It follows that a measurement of the frequency n of the initial oscillatory flow and/or pressure during a DST provides a means of obtaining an estimate of the permeability-porosity product $k\phi$.

Additionally, analysis also shows that the flow velocity or pressure oscillations decay in an exponential manner, with an exponent given by $$\frac{\sqrt{2}}{4}\,\epsilon\,(k\phi)^{\frac{1}{2}} \tag{4}$$

As with the frequency, it will be appreciated that if the decay of the oscillations is measured, then the product $k\phi$ can again be obtained from known or measurable quantities.

In order that features of the present invention may be further appreciated, its application to the results of a typical DST will now be considered.

Figure 2:
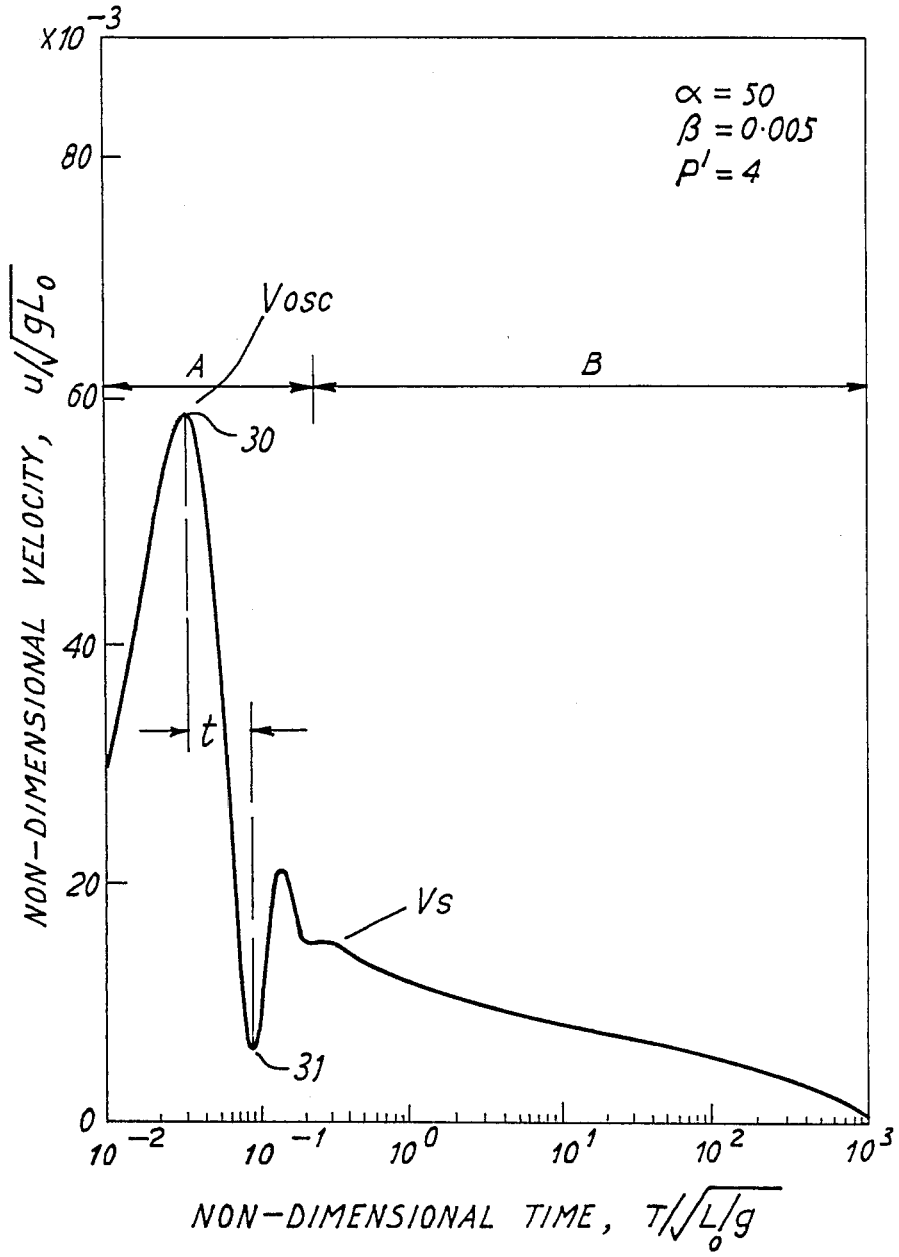
FIG. 2 shows a scaled velocity transducer output during a DST.

Following opening of the down hole valve 15 during a DST, flow velocity is oscillatory for a short period A before steadying for a longer period B (FIG. 2). Flow velocity may be calculated from pressure measurements from a conventional pressure transducer, and is commonly plotted on a log scale against time, having first been scaled by $\sqrt{(gL_o)}$ and $\sqrt{(L_o/g)}$ and respectively to give dimensionless quantities, as shown in FIG. 2. However, as will become apparent hereinafter, it is preferable that flow rate be measured directly by a suitable flow transducer, as well as or instead of indirectly by the aforementioned pressure transducer.

In conventional analysis of DST results, calculations are performed on measurements (for example pressure measurements) made during the period B. However, in applying the present invention, the oscillatory period A is of interest, and in particular the instantaneous value of the frequency of oscillation n, the rate of decay (or damping) of this oscillation, and the magnitudes of the peak flow velocity $V_{osc}$ and the flow velocity $V_s$ about which the oscillations take place. The frequency n may be estimated by any convenient method, for example by measurement of the time t between consecutive peaks 30, 31 as a half wavelength to establish a value for n. Given n, the permeability-porosity product $k\phi$ may be estimated by applying the foregoing relationships in conjunction with values for A, h, $r_w$, $L_o$, g, $\rho$ and c, which will be known either as a result of the drilling configuration used, or by means of sample analysis.

Figure 3:
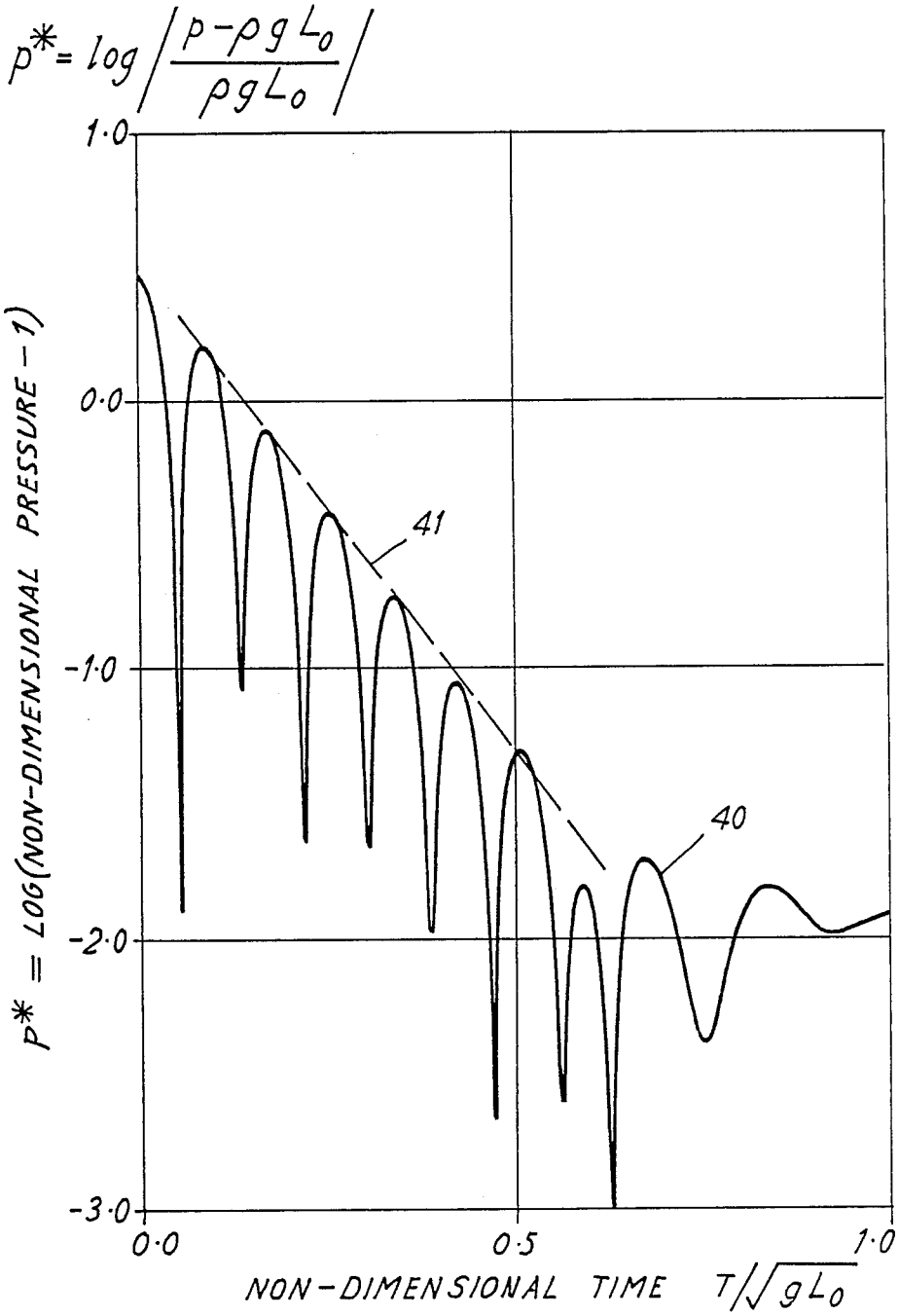
FIG. 3 is a graph enabling decay (or damping) of oscillatory flow transients to be determined.

In the case of the damping, analysis shows that when the valve 15 is opened, the bottom hole pressure will oscillate about the hydrostatic pressure of the cushion 16 in FIG. 1. This pressure is $\rho gL_o$. If p is the measured pressure then damping may be obtained by plotting the quantity $$p^* = \log\left|\frac{p - \rho gL_o}{\rho gL_o}\right| \tag{5}$$

against time. FIG. 3 gives an example of such a plot at 40, and the slope of the line 41 connecting the peaks gives the damping rate.

Thus measuring the frequency and the damping of the flow oscillations during the oscillatory period A enables two independent estimates to be made of the permeability-porosity $k\phi$.

It will now be realised that the present invention represents a significant departure from previous methods of DST data analysis. In particular, analysis is applied to the early part of the recorded data, while flow is oscillatory, and, for the analysis so far described, absolute values for flow velocity are not required, since the analysis is based on accurate measurement of frequency and damping rate only. Thus flow velocity may be measured by an uncalibrated and inexpensive pressure transducer, saving greatly on the extensive calibrations required to perform a conventional DST.

The accuracy of the permeability-porosity product estimation benefits from a fast acting valve, such that the excitation applied to the system approximates a step function. Where the valve is very fast acting, the above analysis may require some compensation for the propagation of acoustic waves in the fluid in the well bore and for the presence of both gas and liquid in the fluid.

Another important feature of the invention is that it enables estimates of the permeability-porosity product to be obtained in the region near the well bore traditionally referred to as the skin zone. It is well known that an oscillatory wave decays as it propagates into a formation such that the thickness of zone in which significant pressure and flow oscillation occur is proportional to $$\sqrt{K/n}$$

where K is the diffusivity of the formation (and is equal to $k/\rho\phi C$), and n is the frequency of oscillation as before.

It is not possible to be completely general about the zone in which the permeability-porosity product is obtained from the present analysis but, for most practical cases, it produces estimates that are approximate to the formation zone near the well bore. Traditional DST analysis is not able to distinguish features of the zone near the well bore.

It will be appreciated that the present analysis has been carried out for a formation in which the formation permeability and porosity are assumed to be constant. Generally this is not true in a practical formation, and analysis of practical measurements may require compensation to allow for the non-homogeneity of the formation.

Further information about the formation can also be obtained from absolute measurements of the flow velocity in the drill pipe 14 in FIG. 1. Extensive numerical calculations have shown that the peak oscillatory velocity, $V_{osc}$, and the peak non-oscillatory velocity, $V_s$, give information about $\phi$ and k separately. The peak velocity is given by:

$$V_{osc} = \frac{2\,(p_1 - \rho gL)_o}{\rho gL_o} \cdot \left[\frac{A}{\pi r_w^2 h\rho\phi c}\right]^{\frac{1}{2}} \tag{6}$$

The peak non-oscillatory velocity $V_s$ is given by:

$$V_s = \frac{k}{\mu} \cdot \frac{(p_1 - \rho gL)_o}{(A/\pi h)} \tag{7}$$

where $\mu$ is the fluid viscosity. This expression contains the permeability k only, and not the porosity. All other quantities are known or measurable. It will be appreciated that a knowledge of the velocities $V_{osc}$ and $V_s$ will enable separate estimates of $\phi$ and k to be made. The method requires a calibrated velocity transducer, as absolute values of velocity are needed.

It should be understood that all of the results so far discussed may need some refinement to include additional factors such as non-homogeneity, friction losses and so on, but the principle of obtaining the formation parameters k and $\phi$ from an analysis of the oscillatory flow or pressure is at the core of the present invention.

We claim:

1. A method for investigating the oil producing potential of a subsurface formation zone surrounding a well bore, said method comprising the steps of:

(a) installing in proximity to said subsurface formation zone, drill stem test equipment capable of controlling the flow of formation fluid out of the formation zone;

(b) establishing by the operation of said drill stem test equipment, a downhole flow condition in which formation fluids flow out of the formation zone while exhibiting an initial, naturally damped oscillatory behavior dependent on characteristics of said formation;

(c) detecting a time varying characteristic of said initial, naturally damped oscillatory behavior and generating a signal indicative thereof; and (d) in response to said signal, determining a characteristic of said formation.

2. A method as claimed in claim 1, wherein said characteristic of said formation is the product of porosity and the permeability of the formation.

3. A method as claimed in claim 2, wherein said determining step includes determining the frequency of oscillation of said naturally damped oscillatory behavior.

4. A method as claimed in claim 3, wherein the permeability-porosity product is estimated from the formula $$n = n_o\left[1 - \frac{\sqrt{2}}{4}\,\epsilon\,(k\phi)^{\frac{1}{2}}\right] \tag{1}$$

where n, $n_o$, $\epsilon$, k and $\phi$ are as hereinbefore defined.

5. A method as claimed in claim 2, wherein said determining step includes determining the damping of said naturally damped oscillatory behavior.

6. A method as claimed in claim 5, wherein the permeability-porosity product is estimated from the formula $$\text{damping} = \frac{\sqrt{2}}{4}\,\epsilon\,(k\phi)^{\frac{1}{2}} \tag{4}$$

where c, k and $\phi$ are as hereinbefore defined.

7. A method as claimed in claim 1, wherein said detecting step includes measuring pressure.

8. A method as claimed in claim 1, wherein said determining step includes measuring flow velocity.

9. A method as claimed in claim 8, wherein said computing step comprises determining the peak oscillatory flow velocity and estimating porosity therefrom.

10. A method as claimed in claim 9, wherein porosity is estimated from the formula $$V_{osc} = \frac{2\,(p_1 - \rho g L)_o}{\rho g L_o}\cdot\left[\frac{A}{\pi r_w^2 h \rho \phi c}\right]^{\frac{1}{2}} \tag{6}$$

where $V_{osc}$, $p_i$, $\rho$, g, $L_o$, A, $r_w$, h, $\phi$ and c are as hereinbefore defined.

11. A method as claimed in claim 8, wherein said determining step further comprises determining the peak non-oscillatory flow velocity and estimating the permeability of the formation therefrom.

12. A method as claimed in claim 11, wherein permeability is estimated from the formula $$V_s = \frac{k}{\mu}\cdot\frac{(p_1 - \rho g L)_o}{(A/\pi h)} \tag{7}$$

where $V_s$, k, $\mu$, $p_i$, $\rho$, g, $L_o$, A and h are as hereinbefore defined.

13. The method as claimed in claim 1 wherein said characteristic of said formation relates to permeability.

14. A method as claimed in claim 13, wherein said determining step includes determining the frequency of said oscillatory transients.

15. A method as claimed in claim 13, wherein said determining step includes determining the damping of said oscillatory transient.

16. A method as claimed in claim 13, wherein said detecting step includes measuring pressure.

17. A method as claimed in claim 13, wherein said detecting step includes measuring flow velocity.

18. A method as claimed in claim 17, wherein said determining step comprises determining the peak non-oscillatory flow velocity and estimating permeability therefrom.

19. A method as claimed in claim 18, wherein permeability is estimated from the formula $$V_s = \frac{k}{\mu}\cdot\frac{(p_1 - \rho g L)_o}{(A/\pi h)} \tag{7}$$

where $V_s$, k, $\mu$, $p_i$, $\rho$, g, $L_o$, A and h are as hereinbefore defined.

* * * * *